United States Patent [19]

Prouty et al.

[11] 3,978,440

[45] Aug. 31, 1976

[54] PUSH TO START DUAL RELAY

[75] Inventors: Robert E. Prouty; Cecil A. Lambert, both of Logansport, Ind.

[73] Assignee: Essex International, Inc., Fort Wayne, Ind.

[22] Filed: Sept. 9, 1974

[21] Appl. No.: 504,436

[52] U.S. Cl. ..... 335/186; 34/53; 335/136

[51] Int. Cl.² ..... H01H 3/20

[58] Field of Search ..... 335/186, 164, 165, 159, 335/160, 161, 136; 200/159, 243; 34/53, 55

[56] References Cited

UNITED STATES PATENTS

| | | | |
|---|---|---|---|
| 3,304,621 | 2/1967 | Nelson | 34/53 |
| 3,622,925 | 11/1971 | Rose | 335/186 |
| 3,733,568 | 5/1973 | Prouty et al. | 335/186 |
| 3,832,658 | 8/1974 | Hayden | 335/186 |

*Primary Examiner*—Harold Broome
*Attorney, Agent, or Firm*—Robert D. Sommer; Lawrence E. Freiburger

[57] ABSTRACT

A push to start dual relay having master electrical contacts which are closed when a push button is depressed. The master contacts control the power supplied to a control circuit which, in turn, controls the power supplied to two relays. When the push button is released and either one or both relays are energized, the master contacts remain in the closed position. When the push button is released and both relays are deenergized, however, the master contacts are allowed to open.

7 Claims, 5 Drawing Figures

PUSH TO START DUAL RELAY

BACKGROUND OF THE INVENTION

This invention pertains to relays and more particularly to push button operated relays. Relays of this type have generally included a push button which positively closes electrical contacts to complete an electrical circuit through the contacts. Closure of the electrical contacts also completed a circuit to the relay coil, thereby energizing the coil. Generally, in the prior art, as long as the relay coil was energized the contacts were held in, independent of the operation of the push button.

Relays of this general type are shown, for example, in U.S. Pat. Nos. 3,622,925 and 3,733,568, and are used in many appliances wherein a push to start feature is desirable, such as clothes dryers, microwave ovens, etc. However, these relays have generally included only one set of normally open contacts. Thus, the prior art push button relays were generally able to control only one function, or more than one function simultaneously, of a multifunction appliance. For example, with a prior art push button relay only the heater, the motor, or both the heater and the motor simultaneously of an electric clothes dryer could be controlled by the push to start relay.

With permanent press and other modern faabrics it has been found desirable to cycle the heater and motor on and off in accordance with a predetermined program in order to obtain the optimum drying conditions. In the prior art, the program was generally controlled by a timer motor.

However, with the increased use of electronic solid state circuitry in appliances today, it has become desirable to replace the timer motor with an electronic control unit which controls the power supplied to both the heater and the motor.

SUMMARY OF THE INVENTION

The present invention is directed to a push button relay structure having normally open master contacts which are closed by the push button and which control the power supplied to the control unit. The control unit, in turn, controls the energization of two relays, one normally open and one normally closed, which control the power supplied to the heater and the motor, respectively. In addition, a mechanical interlock between each of the relays and the master contacts prevents the master contacts from opening while either one or both relays are energized. However, as soon as both relays are deenergized at the same time, the master contacts are allowed to open, thus opening the circuit to the control unit.

The relay structure of the present invention includes two pivotal relay armatures and a pivotal actuator which are movable between actuated and unactuated positions and which are mounted in parallel fashion on a base member. When depressed, a push button urges the actuator toward the base member to close the master contacts through which power is supplied to the control unit. Each of the two relay armatures is attracted to the actuated position by a separate electromagnetic coil so that the two relays may be controlled independently of one another. In addition, the two relay armatures are mechanically interlocked with the actuator such that the actuator remains in the actuated position when either one or both of the relay armatures are in the actuated position.

Thus, it is an object of the invention to provide a push button relay structure which has master contacts operated by the push button and which are held in the actuated position whenever one or both of two relays is energized.

It is a further object of the present invention to provide a push button relay for use in appliances and the like which has master contacts operated by the push button through which power is supplied to a control unit and two relays operated by the control unit which are interlocked with the master contacts so that the master contacts are held in as long as one or both of the relays are energized.

These and other objects of the present invention will become apparent from the detailed description of the invention taken in conjunction with the drawings, in which:

DESCRIPTION OF THE PREFERRED EMBODIMENT

Figure 1:
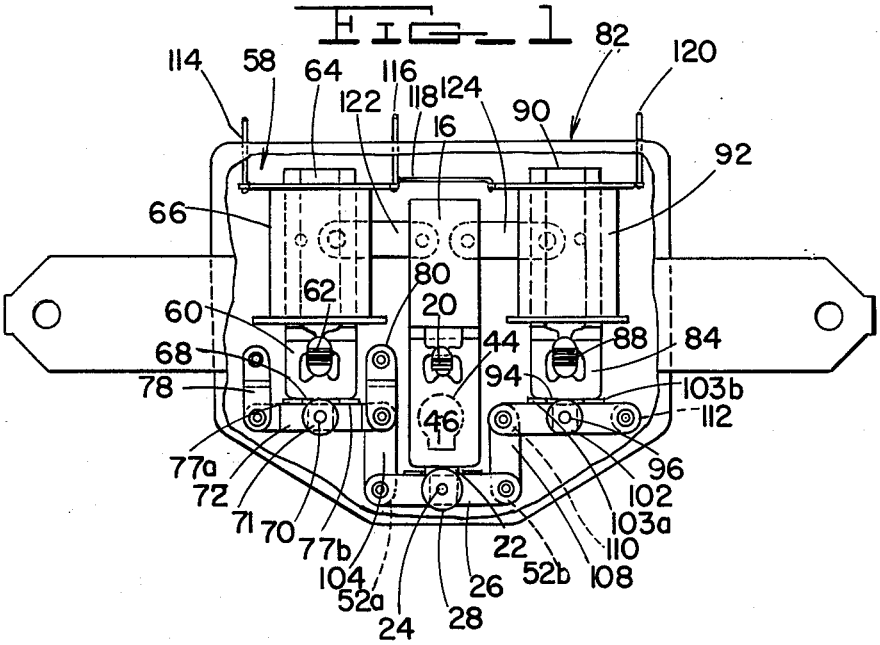
FIG. 1 is a top elevational view with part of the cover and the push button removed of a push button relay in accordance with the present invention.
Figure 2:
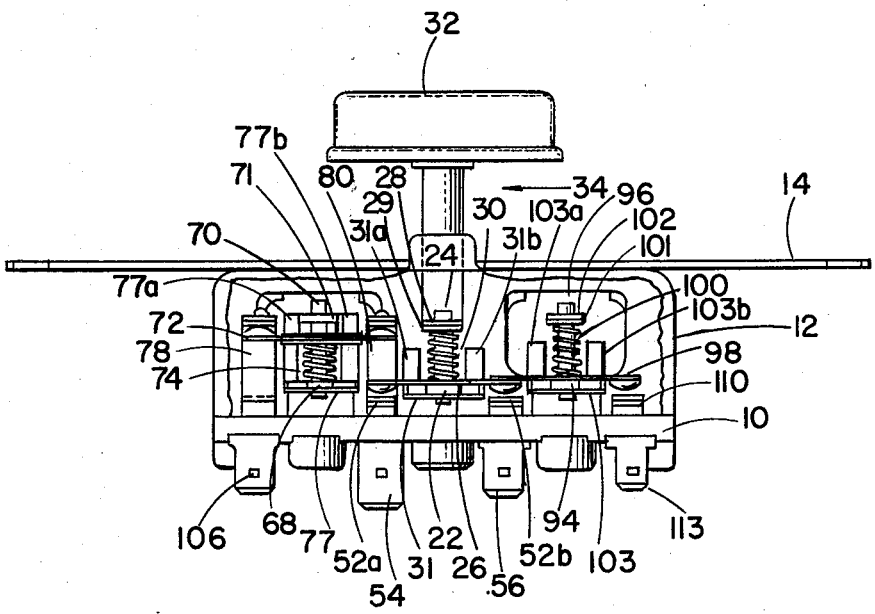
FIG. 2 is a front elevational view with part of the cover removed of the relay shown in FIG. 1.
Figure 3:
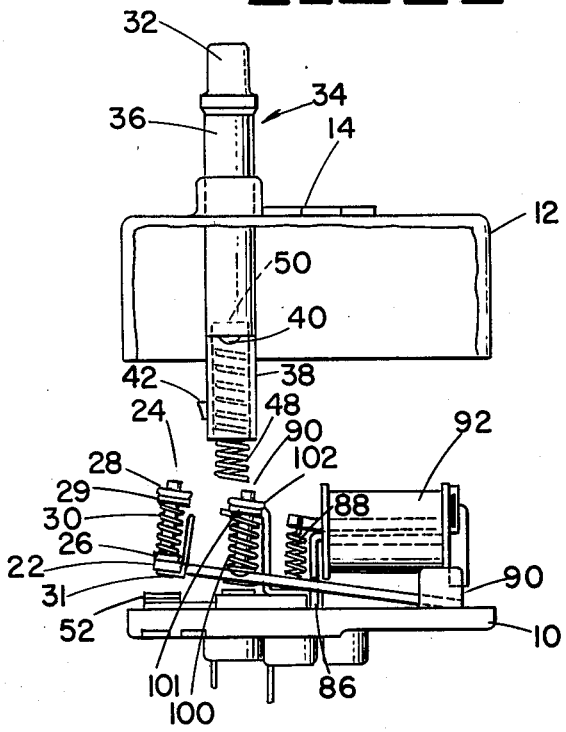
FIG. 3 is a partially exploded side elevational view of the relay shown in FIG. 1.

Referring now to FIGS. 1, 2 and 3, there is shown a push button relay constructed in accordance with the present invention. The housing for the relay includes a base member 10 upon which the components of the relay are mounted and a cover member 12 adapted to mate with the base member 10 to form an enclosure for the relay. A mounting plate 14 is attached to the upper side of the cover 12 for use in mounting the relay.

In accordance with the present invention, the push button relay also includes an elongated, flat actuator 16, pivoted on a fulcrum (not shown) and biased to the unactuated position by a tension spring 20 which urges the armature 16 in a clockwise direction as viewed in FIG. 3. A contact assembly connected to a rectangular extension 22 of the actuator 16 includes a post 24 rigidly attached at one end to the extension 22, a bridging contact carrying arm 26 slidably mounted thereon, a collar 28 integral with and attached to the other end of the post 24, a washer shaped collar 29 slidably mounted on post 24, and compression spring 30 mounted concentrically on the post 24 between the collar 29 and the contact carrying arm 26. Such a contact mounting arrangement provides a resilient contact mounting which eliminates the necessity for very close tolerances. In addition, the contact carrying arm 26 is prevented from rotating by a guide 31 attached to the underside of the actuator extension 22 which has fingers 31*a* and 31*b* extending upwardly on opposite sides of the armature.

The actuator 16 is adapted to be manually urged to the actuated position by a push button assembly which includes a push button knob 32 mounted securely on a push button shaft 34. The push button shaft 34 may have a first portion 36 of generally rectangular shaped cross-section which is slidably mounted in a corresponding rectangular aperture in the cover, thus preventing rotation of the shaft 34. A second portion 38 of the shaft is generally circular in cross section and has a pair of diametrically opposed, outwardly extending lugs or ears 40 mounted at the junction of shaft portions 36 and 38. The second portion 38 has an additional lug 42 extending outwardly therefrom.

One advantageous feature of the push button assembly thus far described is that it allows for both push-to-start only and push-to-start pull-to-stop operation depending upon how the push button assembly is assembled. For push-to-start only operation, when the relay is assembled, a portion 38 extends through an aperture 44 in actuator 16 and lug 42 is aligned with notch 46 in aperture 44. A compression spring 48 extends into a cylindrical cavity 50 within the push button shaft 34 and is maintained in compression between the base 10 and the top of cavity 50. Thus, when assembled for push-to-start only operation it can be seen that the push button, biased upwardly by spring 48, is in the off position and the lugs 40 do not contact the actuator 16. However, when the push button is depressed against the bias of spring 48, lugs 40 straddle the aperture 44 and urge armature 16 toward the actuated position. Eventually the electrical contacts mounted at the end of contact carrying arm 26 will make with fixed contacts 52*a*, 52*b* and complete a circuit from terminal 54 to terminal 56. When the push button is released, the resiliency of the spring 48 will return it to the normal position. However, the actuator 16 will remain in the actuated position because it is interlocked with the two relay armatures as hereinafter described.

For push-to-start, pull-to-stop operation, the relay is assembled with the push button shaft 34 inserted into the aperture 44 so that lug 42 is on the underside of the actuator 16 and lugs 40 are on the upper side of the actuator. The shaft 34 is then rotated 180° so that when the push button 32 is depressed, lugs 40 urge the actuator 16 to the actuated position and when the push button is pulled the lug 42 pulls the actuator 16 to the unactuated position.

In the preferred embodiment of the invention, the actuator 16 is mechanically interlocked with the armatures of two single pole, single throw relays, one normally open and one normally closed. The first relay, generally indicated by reference numeral 58, includes a magnetizable flat armature 60 which is pivoted about a fulcrum (not shown) and biased to the unactuated position by a tension spring 62. Armature 60 is attracted to pole piece 64 whenever electromagnetic coil 66 is energized.

A normally closed contact assembly is mounted securely on a rectangular extension 68 of armature 60. The normally closed contact assembly includes a post 70 rigidly attached to armature extension 68 at one end and having an integral collar 71 at the other end, an insulated contact carrying arm 72 slidably mounted on post 70 and a compression spring 74 mounted concentrically on the post 70 between the contact carrying arm 72 and the armature extension 68. Relay 58 thus forms a switch in which the contact carrying arm 72 bridges contacts fixed to contact carrying brackets 78 and 80 whenever the electromagnetic coil 66 is deenergized and the armature 60 is in the unactuated position.

Relay 58 also has a guide 77 having fingers 77*a* and 77*b* to prevent rotation of contact carrying arm 72.

A second relay 82 is mounted on the base 10 and is identical to relay 58 with the exception that relay 82 has a normally open switch configuration. Thus relay 82 has an armature 84 pivoted on a fulcrum 86, biased to the unactuated position by spring 88, and attracted to pole piece 90 when electromagmetic coil 92 is energized. The normally open switch assembly operated by relay 82 includes armature extension 94 upon which is mounted a post 96 having an integral collar 102 rigidly attached thereto and a washer shaped collar 101 slidable thereon. A contact carrying arm 98 having an electrical contact mounted at each end thereof is slidably mounted on the post 96. A compression spring 100 mounted concentrically on post 96 between contact carrying arm 98 and collar 101 urges contact carrying arm 98 against armature extension 94. In addition, a guide 103 having two upwardly extending fingers 103*a* and 103*b* prevents rotation of contact carrying arm 98 on post 96. For a more detailed discussion of the structure of relays 58 and 82 reference may be had to U.S. Pat. No. 3,825,865, assigned to the same assignee as the present invention.

In the preferred embodiment of the invention, contact carrying arm 26 is adapted to bridge contacts 52*a* and 52*b*, thus completing an electrical circuit between terminals 54 and 56. A bus bar 104 mounted on base 10 electrically connects contact 52*a* with contact carrying bracket 80 and terminal 106 is connected to contact carrying bracket 78 so that normally closed contact carrying arm 72 completes a circuit from terminal 54 to terminal 106. Contact carrying arm 98 is adapted to bridge contact 110, connected to contact 52*b* by bus bar 108, and contact 112 which is connected to terminal 113. Electrical connections to electromagnetic coil 66 made through wires 114 and 116 and electrical connections are made to electromagnetic coil 92 by wire 118 and 120.

Figure 4:
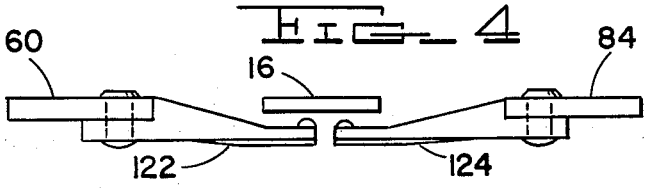
FIG. 4 is an enlarged elevational view showing the interconnection between the main armature 16 and the two relay armatures 66 and 84.

One of the important aspects of the relay structure of the present invention is the mechanical interlock between the actuator 16 and the two relay armatures 60 and 84. Referring now to FIG. 4, armature 60 has an elongated interlocking finger 122 which is rigidly connected to armature 60, such as by riveting and which is made of electrical insulating material in order to maintain electrical isolation between the master contacts and the relay contacts. The interlocking finger 122 extends from the armature 60, generally parallel thereto, and abuts against the underside of actuator 16. A second interlocking finger 124 is connected to armature 84 in the same manner and abuts against the underside of actuator 16. It can thus be seen that whenever either armature 60 or 84 is in the actuated position (pivoted to the most counter clockwise position as viewed from the same angle as FIG. 3), the interlocking finger (122 or 124) will urge the main actuator 16 to the actuated position.

Figure 5:
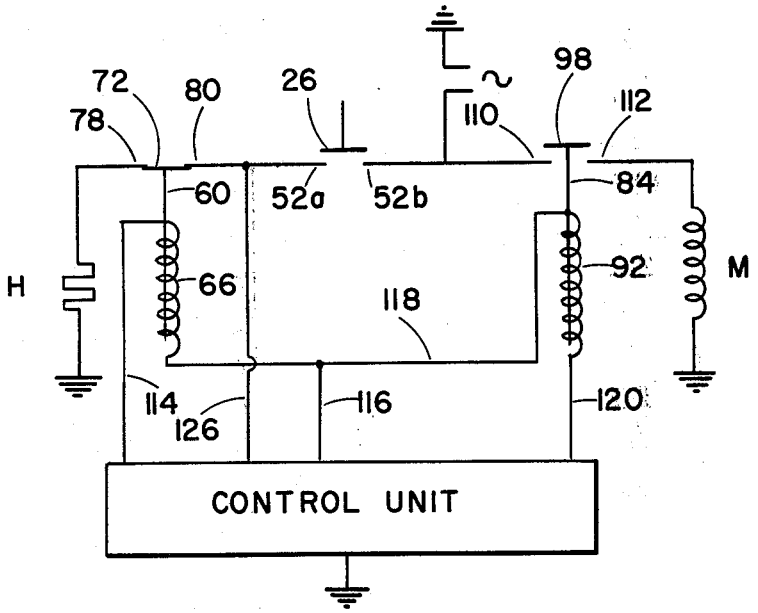
FIG. 5 is an electrical schematic diagram showing the cooperation between the relay of FIGS. 1–4 and a control unit for use in an electrical appliance.

In FIG. 5 there is shown an electrical schematic which utilizes the push to start dual relay of the present invention. It should be understood that the electrical schematic shown in FIG. 5 and the following discussion are for illustrative purposes only and that there is no intention to limit the use of the present invention to the particular application shown in FIG. 5 and discussed below.

FIG. 5 shows how the relay of the present invention can be used to control an electric clothes dryer. 220 volt line voltage may be connected to contact 52*b* via terminal 56. When it is desired to start the dryer, the push button is depressed, bringing bridging contact carrying member 26 into contact with contacts 52*a* and 52*b* and supplying electrical power to the control unit through line 126 (connected to terminal 54). As soon as electrical power is supplied to the control unit, the control unit controls the actuation of relays 58 and 82 according to a predetermined program. The predetermined program is selected so that at any given time during the desired operating cycle, at least one of electromagnetic coils 66 and 92 are energized. Thus, because of the mechanical interlock between actuator 16 and armatures 60 and 84, it can be seen that as long as either armature 60 or 84 remains in the energized position, actuator 16 will remain in the actuated position, thus maintaining bridging contact member 26 in the closed position. It can further be seen that whenever relay 66 is deenergized, armature 60 will be in the unactuated position and a circuit will be completed from the line voltage source through contact 52*b*, bridging contact carrying arm 26, contact 52*a*, contact 80, bridging contact carrying arm 72, contact 78 to the heater H of the clothes dryer, via terminal 106. In the same manner, whenever relay 82 is energized, armature 84 will be in the actuated position and a circuit will be completed through contact 110, bridging contact carrying arm 98 and contact 112 to motor M of the clothes dryer via terminal 113.

Of course, as described above, the relay may be constructed so as to provide push-to-start only operation whereby the push button 32 returns to its original position after it is depressed or push-to-start pull-to-stop operation whereby the push button 32 remains in an actuated position after depression and the machine may be manually stopped by pulling on the push button, retracting it to its original position.

Modifications and alterations may be made without departing from the true spirit of the invention which is defined in the following claims.

What is claimed is:

1. A push button switch assembly, comprising:

base and cover members adapted to form an enclosure for said switch assembly;

a flat elongated contact actuator mounted for pivotal movement on said base and movable between first and second positions;

electrical contact means operatively connected to said contact actuator;

spring means for biasing said contact actuator to said first position;

a push button shaft having a first portion slidably mounted in said cover member;

a circular aperture in said contact actuator;

a notch in said circular aperture;

said push button shaft having a second portion which is circular in cross section and which is slidable in said circular aperture;

spring means for biasing said push button shaft to an unactuated position;

a first ear on said push button shaft extending from said second portion and adapted to engage a first side of said contact actuator when said push button shaft is depressed to move said contact actuator to said second position;

a second ear extending from said second position and disposed adjacent the second side of said contact actuator;

interlocking means for holding said contact actuator in said second position; and said second ear being adapted to align with and pass through said notch when said push button shaft is rotated to a first position and being adapted to engage the second side of said contact actuator when said push button shaft is rotated to a second position.

2. A relay assembly, comprising:

base and cover members adapted to mate with one another to form an enclosure for said relay assembly;

a flat, rigid, elongated contact actuator mounted for pivotal movement on said base and movable between actuated and deactuated positions;

spring means for biasing said contact actuator to said deactuated position;

electrical contact means operatively connected to said contact actuator;

push button means slidably mounted in said cover member, said push button means being movable between a first position and a second position for manually urging said contact actuator to said actuated position;

spring means for biasing said push button means to said first position;

said push button means including means thereon for engaging a first side of said contact actuator when said push button means is moved from said first position to said second position whereby said contact actuator is moved from the deactuated to the actuated position;

said push button means further including means thereon for selectively engaging a second side of said contact actuator when said push button means is moved from said second position to said first position whereby said contact actuator is moved from the actuated to the deactuated position;

a relay mounted on said base member, said relay having an electromagnetic coil and a flat, elongated pivotal armature movable between actuated and deactuated positions; and interlocking means on said relay armature for holding said contact actuator in the actuated position.

3. The relay assembly as claimed in claim 2, further comprising:

a circular aperture in said contact actuator;

a notch in said circular aperture;

said push button means comprises a push button shaft having a first portion slidably mounted in said cover member and a second portion of circular shaped cross section which is slidable in said circular aperture;

said means on said push button means for engaging a first side of said contact actuator comprises a first ear on said push button shaft extending from said second portion and adapted to engage said first side of said contact actuator when said push button shaft is depressed;

said means on said push button means for selectively engaging a second side of said contact actuator comprises a second ear on said push button shaft extending from said second portion and disposed adjacent said second side of said contact actuator;

said second ear being adapted to align with and pass through said notch when said push button shaft is rotated to a first position and being adapted to engage the second side of said contact actuator when said push button shaft is rotated to a second position.

4. In a control system for an electric clothes dryer, including a control unit for controlling the power supplied to the electric heater and the electric motor, and a push button relay assembly for controlling the power supplied to the control unit, the improvement in the push button relay assembly which comprises:

manually operated electrical contact means movable between actuated and unactuated positions for controlling the electrical power supplied to said control unit;

first relay means operated by said control unit for controlling the electrical power supplied to said electric motor, said first relay means having an armature movable between actuated and unactuated positions;

second relay means operated by said control unit for controlling the electric power supplied to said electric heater, said relay means having an armature movable between actuated and unactuated positions;

first interlocking means for maintaining said manually operated electrical contact means in the actuated position when the armature of said first relay means is in the actuated position; and second interlocking means for maintaining said manually operated electrical contact means in the actuated position when the armature of said second relay means is in the actuated position.

5. The improved push button relay assembly as claimed in claim 4, wherein:

said manually operated electrical contact means comprises a flat, pivotal contact actuator having electrical contacts operably attached thereto;

said first relay means comprises an electromagnetic coil and a first pivotal armature attracted thereto for operating electrical contacts which control the electrical power supplied to said electric motor;

said second relay means comprises an electromagnetic coil and a second pivotal armature attracted thereto for operating electrical contacts which control electrical power supplied to said electric heater;

said first interlocking means comprises a first interlocking finger rigidly attached to said first relay armature, said first interlocking finger urging said contact actuator to the actuated position whenever said first relay armature is in the actuated position; and said second interlocking means comprises a first interlocking finger rigidly attached to said second relay armature, said second interlocking finger urging said contact actuator to the actuated position whenever said first relay armature is in the actuated position.

6. A relay assembly, comprising:

base and cover members adapted to mate with one another to form an enclosure for said relay assembly;

a flat, elongated, contact actuator pivotally mounted on said base and movable between actuated and deactuated positions;

spring means for biasing said contact actuator to said deactuated position;

electrical contact means operatively connected to said contact actuator;

push button means slidably mounted in said cover member for manually urging said contact actuator to said actuated position;

a first relay mounted on said base member, said first relay having an electromagnetic coil and a flat elongated pivotal armature movable between actuated and deactuated positions;

first interlocking means on said first relay armature for holding said contact actuator in the actuated position;

a second relay mounted on said base member, said second relay having an electromagnetic coil and a flat, elongated, pivotal armature movable between actuated and deactuated positions; and second interlocking means on said second relay armature for holding said contact actuator in the actuated position when said second relay armature is in the actuated position.

7. The relay assembly as claimed in claim 6, wherein said first and second interlocking means comprises:

a first, rigid interlocking finger securely attached to said first relay armature;

said first interlocking finger urging said contact actuator to the actuated position whenever said first relay armature is in the actuated position;

a second, rigid interlocking finger securely attached to said second relay armature; and said second interlocking finger urging said contact actuator to the actuated position whenever said second relay armature is in the actuated position.

* * * * *